US007598011B2

(12) United States Patent
Kobayashi et al.

(10) Patent No.: US 7,598,011 B2
(45) Date of Patent: Oct. 6, 2009

(54) IRREGULAR SHAPED FERRITE CARRIER AND ELECTROPHOTOGRAPHIC DEVELOPER USING THE FERRITE CARRIER

(75) Inventors: Hiromichi Kobayashi, Kashiwa (JP); Toru Iwata, Kashiwa (JP); Toshio Honjo, Kashiwa (JP)

(73) Assignee: Powdertech Co., Ltd., Kashiwa-shi, Chiba (JP)

( * ) Notice: Subject to any disclaimer, the term of this patent is extended or adjusted under 35 U.S.C. 154(b) by 264 days.

(21) Appl. No.: 11/363,262

(22) Filed: Feb. 28, 2006

(65) Prior Publication Data

US 2006/0194137 A1 Aug. 31, 2006

(30) Foreign Application Priority Data

Feb. 28, 2005 (JP) ..... 2005-052781

(51) Int. Cl.
*G03G 9/107* (2006.01)

(52) U.S. Cl. ..... 430/106.1; 430/106.2; 430/108.6; 430/111.3; 430/111.31; 430/111.32; 430/111.33

(58) Field of Classification Search ..... 430/106.1, 430/106.2, 108.6, 111.31, 111.32, 111.33, 430/111.3

See application file for complete search history.

(56) References Cited

U.S. PATENT DOCUMENTS

| | | | | |
|---|---|---|---|---|
| 4,287,283 | A * | 9/1981 | Watanabe et al. | 430/111.34 |
| 5,472,819 | A * | 12/1995 | Hayashi et al. | 430/108.2 |
| 2003/0219279 | A1* | 11/2003 | Nohsho et al. | 399/159 |
| 2006/0099528 | A1* | 5/2006 | Budny et al. | 430/111.31 |
| 2007/0087282 | A1* | 4/2007 | Iinuma et al. | 430/111.31 |

OTHER PUBLICATIONS

Ferrite Beats (F-300), Material Safety Data Sheet is submitted by applicant on Nov. 18, 2008 being considered and made record.*

Ferrite Beats (EFY-50BW), Material Safety Data Sheet is submitted by applicant on Nov. 18, 2008 being considered and made record.*

* cited by examiner

*Primary Examiner*—Hoa V Le

(74) *Attorney, Agent, or Firm*—Rothwell, Figg, Ernst & Manbeck, P.C.

(57) ABSTRACT

It is contemplated to provide irregular shaped ferrite carrier which has a lower resistance, a high specific surface area, a low specific gravity and a longer operational life, and an electrophotographic developer comprising the ferrite carrier which prevents the toner scattering, has a high image density, and is responsive to high-speed and color imaging. The irregular shaped ferrite carrier is characterized in that the carrier particles are irregular shaped, and 40 percent by number or more of the particles have a rock candy sugar shape and/or an oyster shell shape, and that the shape factor ($SF\text{-}1=R^2/S\times\pi/4\times100$, wherein R is a maximum length and S is a projected area.) is 140 to 250, and the distribution width (δ) is 60 or less.

16 Claims, 2 Drawing Sheets

IRREGULAR SHAPED FERRITE CARRIER AND ELECTROPHOTOGRAPHIC DEVELOPER USING THE FERRITE CARRIER

BACKGROUND OF THE INVENTION

1. Field of the Invention

The present invention relates to an irregular shaped ferrite carrier for a two-component electrophotographic developer used for copying machines, printers, and the like, and to an electrophotographic developer using the ferrite carrier, and relates in detail to an irregular shaped ferrite carrier which has a lowered resistance, a high specific surface area, a low specific gravity and a longer operating life, and to an electrophotographic developer which uses the ferrite carrier and which prevents the toner scattering, has a high image density, and is responsive to the high-speed and full-color imaging.

2. Description of the Related Art

The two-component developer used in electrophotography is constituted of a toner and a carrier, and the carrier is a carrier material which is mixed and agitated with the toner in a developer box, gives the toner a desired charge, carries the charged toner to an electrostatic latent image on a photoreceptor, and forms a toner image. The carrier is, after having formed the toner image, held by a magnet and stays on a development roll, further returned to the developer box, again mixed and agitated with new toner particles, and repeatedly used in a certain period.

The two-component developer, different from a one-component developer, is one in which the carrier agitates the toner particles, imparts a desired chargeability to the toner particles, and has a function of transporting the toner, and which has good controllability in developer design, and is therefore widely used in the fields of full-color machines requiring high-quality images and high-speed machines requiring reliability and durability of image sustainability.

In such two-component electrophotographic developers, an iron powder carrier such as an oxide-filmed iron powder or a resin-coated iron powder has been conventionally used. However, since the iron carrier has a large true specific gravity and then imparts a large stress in developing machines, the life-elongation is difficult.

Then, ferrite carriers such as Cu—Zn ferrite and Ni—Zn ferrite, which have a lower true specific gravity than the iron powder carrier, are used. These ferrite carriers also have many characteristics advantageous over the conventional iron powder carrier in obtaining high-quality images.

As these ferrite carriers, spherical ones are commonly used. However, spherical ferrite carriers have a high resistance, are apt to be insufficient in the developing capability, and can hardly respond to the high-speed imaging. Besides, since they have a small specific surface area, and the low retentiveness of toners, the fogging of image and toner scattering are apt to occur.

Then, for enhancing the developing capability of a spherical ferrite, it is proposed that a resin is coated on the surface of the ferrite core, and a conductive agent is added in the resin to lower the resistance. However, the resin of the resin-coated carrier is apt to exfoliate by use over time, and especially the carrier made to have a lowered resistance by a conductive agent has a large change in the resistance during use period, thereby not being able to achieve a sufficiently longer operating life.

Japanese Patent Laid-Open No. 2000-233930 describes a carrier core composition composed substantially of a spinel phase containing manganese oxide and iron (III) oxide as ferrite components and a certain amount of titanium oxide. Containing titanium oxide in such a manner allows to hold a high conductivity, or a low resistivity, and a saturation magnetization above a certain limit.

However, although a certain low resistance is achieved by containing titanium oxide in the ferrite components, since the shape is not controlled, the conductivity of the ferrite particle of the carrier core material is low, and the toner retention is insufficient, whereby the targeted developing capability cannot be obtained, and troubles such as the fogging of image and toner scattering arise.

On the other hand, use of various irregular shaped ferrite carriers in place of the spherical ferrite carrier is proposed. For example, Japanese Patent Laid-Open No. 2002-116582 describes the use of a carrier of $10^8$ to $10^{10}$ Ω·cm in resistivity provided on an irregular shaped ferrite core of 130 or more in shape factor (SF-1) with a coating layer formed by dispersing a conductive powder in a binder resin.

However, with the shape factor (SF-1) specified alone, the conductivity of the magnetic carrier of the carrier core material is not sufficient, and the targeted developing capability cannot be obtained. Moreover, since there is a necessity of using a large amount of conductive powder for enhancing the developing capability, color toners are contaminated, and the image quality degradation is apt to be brought about. Further, when such a large amount of conductive powder is dispersed and contained in the coating layer, the coating layer becomes apt to exfoliate and drop off due to the stress loaded in machine, and thereby the carrier loses its conductivity, which makes it difficult to maintain its favorable characteristics over a long period.

Japanese Patent Laid-Open No. 07-261461 describes a magnetic carrier having an average particle size of 10 to 100 μm nonspherically formed of a magnetite particle having a saturation magnetization of 100 emu/g or more, and describes that it can enhance the image quality and prevent the carrier scattering. Therein, nonspherical shapes include a polyhedron, a multiplanar shape, a scalelike shape, a flat shape and an indeterminate shape.

Although this document proposes that the magnetite is formed into nonspherical particles, whose specific surface area is larger. Since the shape factor and shape distribution are not controlled, the conductivity of the carrier core material as magnetic carrier is low, and the toner retentiveness is not sufficient, so with the higher-speed imaging, a high developing capability is difficult to obtain.

Japanese Patent Laid-Open No. 2002-182434 describes a magnetic carrier in a flat shape whose major axis, minor axis and thickness have a certain relationship and whose easy axis of magnetization is in its plane.

However, when such a magnetic carrier is used, since contact points are scarce, the conductivity is not sufficient, and since the toner retentiveness is nor sufficient, the targeted developing capability cannot be obtained, thus causing troubles such as the fogging of image and toner scattering. The carrier having such a shape has a tendency of being relatively brittle against mechanical impact, and may possibly vary largely its characteristics due to breakage of the carrier particle.

Thus, attempts have not been achieved in which a ferrite carrier is made to have a low resistance, a high specific surface area, a low specific gravity and a longer operating life, and in which when it is rendered into a developer, the toner scattering is prevented, and the developer has a high image density and is responsive to the high-speed and full-color imaging.

SUMMARY OF THE INVENTION

Accordingly, the present invention has an object to provide an irregular shaped ferrite carrier which has a low resistance, a high specific surface area, a low specific gravity and a longer operating life, and an electrophotographic developer comprising the ferrite carrier in which the toner scattering is prevented, and which has a high image density and is responsive to the high-speed and full-color imaging.

As the result of the extensive studies by the present inventors, we have found that, for achieving a low specific gravity and a longer operating life, a ferrite carrier is effective, and for achieving a low resistance, the use as the carrier of an irregular shaped ferrite containing particles of a specified shape in much amount and having a shape factor (SF-1) in a specified range and a distribution width (δ) of a certain value or less is effective, and thus achieved the present invention.

That is, the present invention is to provide an irregular shaped ferrite carrier characterized in that its particle shape is irregular shaped, and particles in a rock candy sugar shape and/or an oyster shell shape are 40 percent by number or more, and the carrier has a shape factor (SF-1), represented by the below expression, of 140 to 250, and its distribution width (δ) of 60 or less.

$$SF\text{-}1=R^2/S\times\pi/4\times100$$

(wherein, R is a maximum length; and S is a projected area.)

Further, in the above irregular shaped ferrite carrier, the particles in a rock candy sugar shape and/or an oyster shell shape are preferably present in 50 percent by number or more.

Besides, in the above irregular shaped ferrite carrier, the shape factor (SF-1) is preferably 145 to 200.

Moreover, in the above irregular shaped ferrite carrier, the ratio of the particles having the shape factor (SF-1) of 140 or more is preferably 40 percent by number or more.

Further, in the above irregular shaped ferrite carrier, the distribution width (δ) of the shape factor (SF-1) is preferably 55 or less.

Besides, in the above irregular shaped ferrite carrier, the ferrite composition is represented preferably by the below formula.

$$(MO)_x(Fe_2O_3)_y$$

(wherein, M is at least one kind selected from Mn, Mg, Sr and Ca; and x+y=100, y is 40 to 95 mol %.)

Moreover, in the above irregular shaped ferrite carrier, the above M is preferably Mn and/or Mg.

Further, in the above irregular shaped ferrite carrier, the above ferrite composition may contain a titanium compound.

Besides, in the above irregular shaped ferrite carrier, the content of the above titanium compound is preferably 5 parts by weight or less in terms of titanium based on 100 parts by weight of the ferrite component.

Further, in the above irregular shaped ferrite carrier, the above ferrite carrier is preferably coated with a resin.

Besides, in the above irregular shaped ferrite carrier, the apparent density is preferably 2.40 g/cm$^3$ or less.

Moreover, in the above irregular shaped ferrite carrier, the specific surface area is preferably 150 cm$^2$/g or more.

Further, in the above irregular shaped ferrite carrier, the average particle size is preferably 30 to 120 μm.

Besides, in the above irregular shaped ferrite carrier, the saturation magnetization is preferably 75 emu/g (A·m$^2$/kg) or more.

Moreover, in the above irregular shaped ferrite carrier, the resistance is preferably $10^2$ to $10^{10}\Omega$.

Further, the above irregular shaped ferrite carrier is preferably used for a color toner.

Besides, the present invention provides an electrophotographic developer composed of the above ferrite carrier and a toner.

Moreover, in the above electrophotographic developer, the above toner is preferably a color toner.

Since the irregular shaped ferrite carrier according to the present invention is composed mainly of particles which has a rock candy sugar shape or an oyster shell shape, and their shape factor (SF-1) in a specified range and their distribution width (δ) of a certain value or less, provides a low resistance, a high specific surface area, and a low specific gravity, thereby leading to a longer operating life. Accordingly, the electrophotographic developer using the irregular shaped ferrite carrier according to the present invention can prevent the toner scattering, has a high image density, and can fully respond to the high-speed and full-color imaging in developing machines.

DETAILED DESCRIPTION OF THE PREFERRED EMBODIMENTS

Hereinafter, the preferred embodiments to practice the present invention will be explained.

<An Irregular Shaped Ferrite Carrier According to the Present Invention>

The irregular shaped ferrite carrier according to the present invention is composed mainly of ferrite particles in a rock candy sugar shape and/or an oyster shell shape. The ferrite particles in a rock candy sugar shape and/or an oyster shell shape are present in 40 percent by number or more in all particles, preferably 50% or more, further preferably 60% or more. With the ferrite particles in a rock candy sugar shape and/or an oyster shell shape of less than 40 percent by number, a sufficiently low resistance cannot be achieved.

Figure 1:
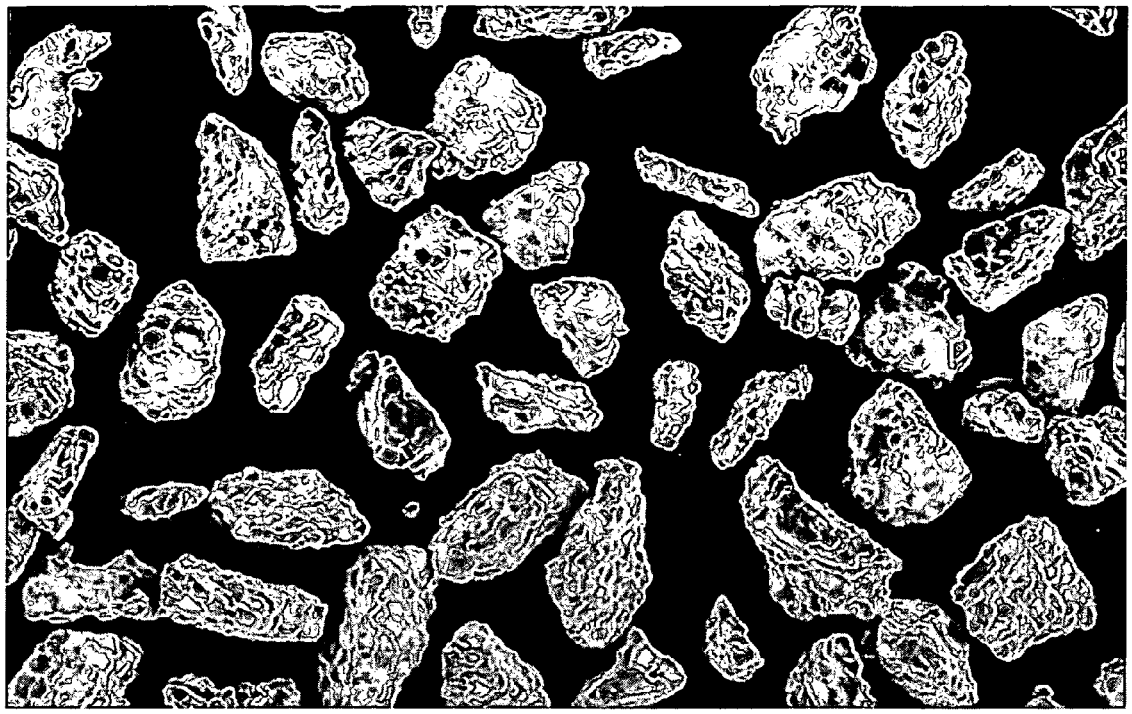
FIG. 1 is an electron micrograph (magnification of 100) of an irregular shaped ferrite carrier (rock candy sugar shape) obtained in Example 1.

The shape referred to as a rock candy sugar shape in the present invention is nearly of an in equilateral polygon as shown in an electron micrograph in FIG. 1

Figure 2:
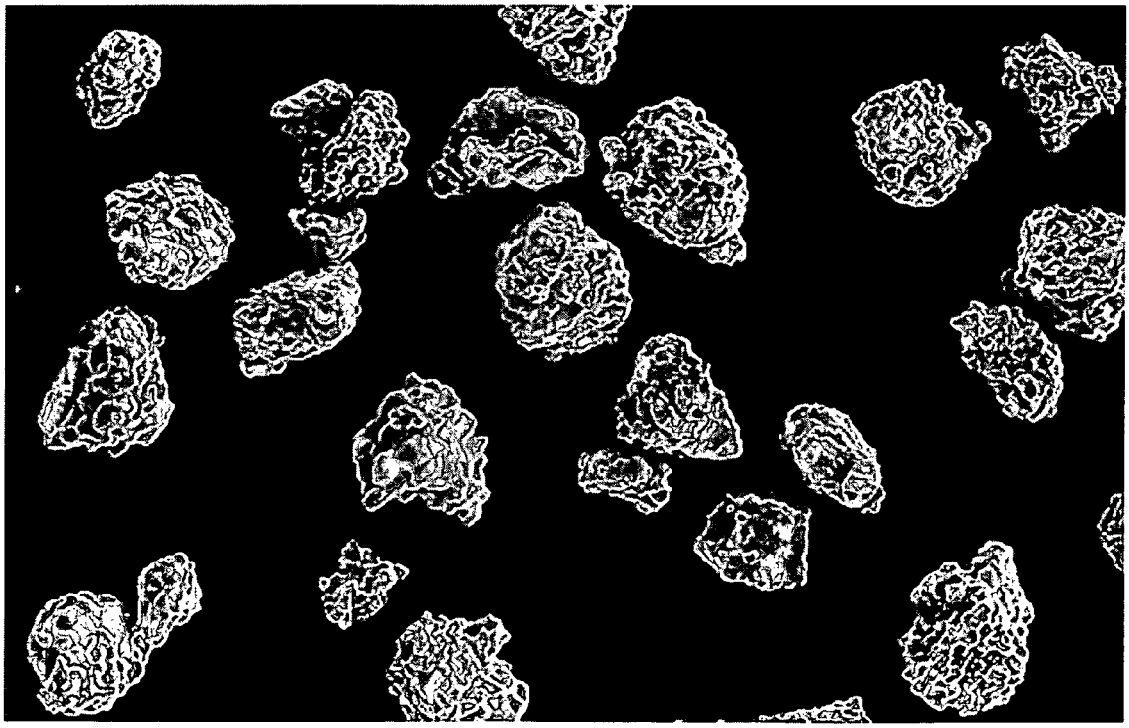
FIG. 2 is an electron micrograph (magnification of 100) of an irregular shaped ferrite carrier (oyster shell shape) obtained in Example 2.

The shape referred to as an oyster shell shape in the present invention is nearly of a massive shape as shown in an electron micrograph in FIG. 2.

The irregular shaped ferrite carrier according to the present invention has a shape factor (SF-1), represented by the below expression, of 140 to 250, preferably 145 to 200, further preferably 150 to 180. With the shape factor (SF-1) of less than 140, the particle shape approaches a spherical shape; mutual contacts between the particles become a few; then the conductivity cannot be raised; and moreover, effects of being rendered into an irregular shape in not exhibited; then the retentiveness of toners is lowered. With that exceeding 250, the shape approaches a needle shape; the particle becomes brittle; then troubles such as breakage of the particle by stress in developing machines become apt to occur.

$$SF\text{-}1=R^2/S\times\pi/4\times100$$

(wherein, R is a maximum length; and S is a projected area.)

Here, the shape factor (SF-1) is used as a factor expressing the shape of a particle, etc., based on a statistical means designated as an image analysis in which the area, length, shape and the like of images taken by a scanning electron microscope, etc., are quantitatively analyzed with a high precision, and can be measured by an image analyzer (image analyzing software Image-Pro Plus, manufactured by Media Cybernetics Inc.). The shape factor (SF-1) is a numerical value obtained by squaring a maximum length of a carrier, dividing the square by a projected area of the carrier, multiplying the quotient by $\pi/4$, and further multiplying the product by 100. With the shape of the carrier closer to a sphere, the value becomes closer to 100. The shape factor (SF-1) is calculated for every particle, and the average value of 50 particles is let be the shape factor of the carrier. The distribution width ($\delta$) shows a standard deviation of the shape factor distribution.

The irregular shaped ferrite carrier according to the present invention is preferably 40 percent by number or more in the ratio of the particles having the shape factor (SF-1) of 140 or more, further preferably 50 percent by number or more, most preferably 60 percent by number or more. When the ratio of the particles having the shape factor (SF-1) of 140 or more is less than 40 percent by number, a sufficient low resistance of the carrier cannot be achieved.

The distribution width ($\delta$) of the shape factor (SF-1) is 60 or less, preferably 55 or less, further preferably 50 or less. With the distribution width ($\delta$) exceeding 60, since the shape distribution of the particles widens, and the uniform formation of magnetic brushes becomes difficult, the carrier adhesion takes place.

The shape factor (SF-2) of the ferrite carrier for an electrophotographic developer according to the present invention is preferably 120 to 250. With the shape factor (SF-2) of less than 120, recesses of the particle surface are a few, and the enlargement of the specific surface area is apt to become difficult. By contrast, with the shape factor (SF-2) exceeding 250, since the particle surface has much unevenness and many pores, the particle is apt to become brittle, so providing stable characteristics over a long period becomes difficult.

This shape factor (SF-2) is calculated by the below expression.

$$SF\text{-}2=L^2/S/4\pi\times100$$

(wherein, L is a projected circumferential length; and S is a projected area.)

The shape factor SF-2 is calculated by taking the micrographs of the carrier particles using a scanning electron microscope, and analyzing the images using the image analyzing software (Image-Pro Plus, manufactured by Media Cybernetics Inc.). The shape factor is calculated for every particle, and the average value for the 50 particles are let be the shape factor of the carrier. Here, the shape factor of 100 means a complete round.

The composition of the irregular shaped ferrite carrier according to the present invention is not especially limited as long as having the above shape, but is preferably one which has a ferrite composition expressed by the below general Formula (1). M is especially preferably Mn and/or Mg among them.

$$(MO)_x(Fe_2O_3)_y$$

(wherein, M is at least one kind selected from Mn, Mg, Sr and Ca; and x+y=100, y is 40 to 95 mol %.)

The irregular shaped ferrite carrier according to the present invention is preferably one in which the above ferrite composition contains a titanium compound. Since incorporation of a titanium compound promotes the ferritization, and provides the stabilization, favorable characteristics of a high magnetization and high conduction can easily be obtained over a long period in cooperation with the shape effect. As the titanium compound, titanium oxide, titanium dioxide, titanium carbonate, etc., are used. The content of the titanium compound is preferably 5 parts by weight or less in terms of titanium based on 100 parts by weight of the ferrite component, further preferably 0.01 to 5 parts by weight. The content of the titanium compound exceeding 5 parts by weight in terms of titanium easily decreases the magnetization and causes the carrier adhesion.

The irregular shaped ferrite carrier according to the present invention is preferably coated with a resin on the surface of the above irregular shaped ferrite (carrier core material) for the purpose of providing highly durable and stable image characteristics over a long period. As the coating resin, various kinds of conventionally known resins may be used. They include, for example, a fluororesin, acrylic resin, epoxide resin, polyamideimide resin, polyimide resin, polyester resin, fluorinated acrylic resin, acryl-styrene resin, silicone resin and a mixed resin formed of at least two selected from those resins, and a modified silicone resin modified with such a resin as an acrylic resin, polyester resin, epoxide resin, polyamideimide resin, polyimide resin, alkyd resin, urethane resin, or fluororesin.

The coating amount of the resin is preferably 0.01 to 10.0 wt. % to the carrier core material, more preferably 0.3 to 7.0wt. %, most preferably 0.5 to 5.0 wt. %. With the coating amount of less than 0.01 wt. %, the formation of a uniform coating layer on the carrier surface is difficult, and the amount exceeding 10.0 wt. % causes cohesion of the carriers themselves, and causes variations in the developer characteristics such as fluidity and charging quantity in actual machines with the decrease in productivity including yield.

Since the coated resin film receives a large stress due to agitation in a developing machine and collisions against a doctor blade, it is susceptible to exfoliation and wear. The spent phenomenon that toners adhere to the carrier surface is also apt to occur. For solving these problems and holding the stable developer characteristics over a long period, a resin containing Formula (I) and/or (II) shown in the below formula, which is favorable in the wear resistance, exfoliation resistance and spent resistance, is preferable. Containing them has also an effect on water repellency.

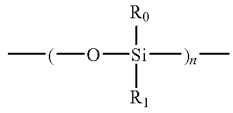

(I)

-continued (II)

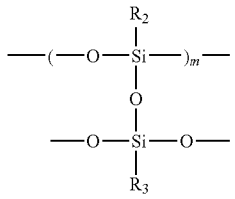

(wherein, $R_0$, $R_1$, $R_2$ and $R_3$ are each a hydrogen atom, a hydroxy group, a methoxy group, an alkyl group of a carbon number of 1 to 4, or a phenyl group.)

Resins containing Formula (I) and/or Formula (II) shown in the above formula include, for example, a straight silicone resin, an organically modified silicone resin and a fluorine-modified silicone resin, as described above.

Further, a silane coupling agent can be introduced as a charge controlling agent in the above coating resin. The chargeability may decrease when the coating is adapted to relatively lessen the exposed area of the core material. The decrease in chargeability can be prevented by adding any of various silane coupling agents. The kind of a suitable coupling agent is not especially limited, but is preferably an aminosilane coupling agent in the case of negative polarity toners, and a fluorinated silane coupling agent in the case of positive polarity toners.

Further, in the above coating resin, conductive microparticles can be added. This is because, when the coating is controlled so as to relatively increase the resin coating amount, the developing capability sometimes decreases due to too high an absolute resistance. However, a rapid charge leakage may take place with too much addition since the resistance of the conductive microparticles themselves is lower than that of the coating resin or the ferrite core. The addition to a content of 25 to 45 vol. % in the coating resin layer as described in Japanese Patent Laid-Open No. 2002-116582 is not preferable because of a severe toner contamination by the conductive microparticles dropping-off during use. Therefore, the adding amount is preferably set to be low enough as compared with that. Since the shape of the core material of the present invention is fully controlled, sufficient image characteristics are provided in no addition of conductive microparticles or in only a small adding amount. The adding amount is specifically 0.25 to 20.0 wt. % to the solid content of the coating resin, preferably 0.5 to 15.0 wt. %, especially preferably 1.0 to 10.0 wt. %. The microparticles include conductive carbon, an oxide such as titanium oxide and tin oxide, and various kinds of organic conductive agents.

The apparent density of the irregular shaped ferrite carrier according to the present invention is preferably 2.40 g/cm$^3$ or less, further preferably 1.50 to 2.30 g/cm$^3$. With the apparent density exceeding 2.40 g/cm$^3$, the longer operating life becomes difficult because of the increased stress in developing machines.

The apparent density is measured according to JIS-Z2504 (Metallic powder-Determination of apparent density).

The specific surface area of the irregular shaped ferrite carrier according to the present invention is preferably 150 cm$^2$/g or more, further preferably 200 to 600 cm$^2$/g. With the specific surface area of less than 150 cm$^2$/g, contacts between the particles themselves become a few; the effect of shape irregularity is not observed; the increase in conduction is difficult; and the toner retentiveness becomes low.

The measurement of the specific surface area is conducted using a powder specific surface area measurement instrument manufactured by Shimadzu Corp. (Model: SS-100).

The average particle size of the irregular shaped ferrite carrier according to the present invention is preferably 30 to 120 μm, further preferably 35 to 110 μm. With the average particle size of less than 30 μm, the carrier adhesion becomes apt to occur, causing white spots. By contrast, with the average particle size exceeding 120 μm, the image quality becomes coarse, and a desired resolution becomes difficult to obtain. Also, the toner retentiveness becomes worse since the specific surface area becomes smaller. In addition, the charging capacity is low, and imparting of charge to toners becomes difficult.

The measurement of the average particle size is conducted using a Microtrac Particle Size Analyzer (Model: 9320-X100) manufactured by Nikkiso Co., Ltd.

The saturation magnetization of the irregular shaped ferrite carrier according to the present invention is preferably 75 emu/g (Am$^2$/kg) or more, further preferably 80 to 97 emu/g (Am$^2$/kg). With the saturation magnetization of less than 75 emu/g (Am$^2$/kg), the carrier adhesion becomes apt to occur, causing white spots.

The measurement of the magnetization is conducted using an integral-type B-H tracer BHU-60 (manufactured by Riken Denshi Co., Ltd.). An H coil for measuring magnetic field and a 4πI coil for measuring magnetization are put in between electromagnets. In this case, a sample is put in the 4πI coil. Outputs of the H coil and the 4πI coil when the magnetic field H is changed by changing the current of the electromagnets are each integrated; and with the H output as the X-axis and the 4πI coil output as the Y-axis, a hysteresis loop is drawn on a chart. The measurement is conducted under the conditions of the sample filling quantity: about 1 g, the sample filling cell: inner diameter of 7 mmϕ±0.02 mm, height of 10 mm±0.1, and 4πI coil: winding number of 30.

The resistance of the irregular shaped ferrite carrier according to the present invention is preferably $10^2$ to $10^{10}$Ω, further preferably $10^2$ to $10^9$Ω. With the carrier resistance of less than $10^2$Ω, the charge leak becomes apt to occur, causing white spots. By contrast, with the carrier resistance exceeding $10^{10}$Ω, troubles such as the decrease in developing capability become apt to occur because of too high resistance.

Figure 3:
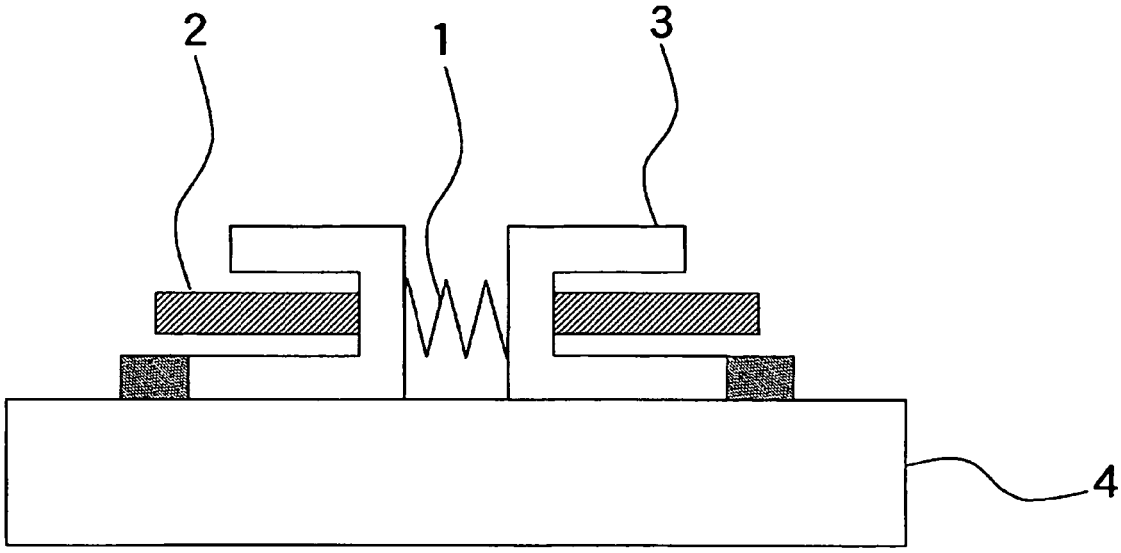
FIG. 3 is an illustrational view of a measuring jig used for resistance measurement.

The measurement of the resistance of the irregular shaped ferrite carrier is conducted using a measuring jig as shown in FIG. 3. In FIG. 3, 1 denotes a sample (carrier core material, resin-coated carrier); 2 denotes a magnet; 3 denotes electrodes (brass plate); and 4 denotes an insulator (fluororesin plate). A sample of 200 mg is weighed, and inserted between parallel flat electrodes (area of 10×40 mm) with an electrodes-gap of 6.5 mm. Then, the N pole and S pole of a magnet (the surface magnetic flux density: 1,500 gauss, the area of opposing parts of the magnet: 10×30 mm) are made to oppose each other and to attach the parallel flat electrodes, whereby the sample is held between the electrodes. Then, the measurement is conducted using SM-8210 manufactured by TOA Electronics Ltd.

<A Production Method of a Ferrite Carrier for Developers According to the Present Invention>

Then, an example of a production method of a ferrite carrier for developers according to the present invention will be explained.

First, to a predetermined composition, a ferrite raw material is weighed, then added with titanium dioxide and optionally with additives such as PVA, water and carbon black, and mixed in a mixer having high speed stirring blades, granulated by a pressure molding machine, and thereafter calcined. Then the calcined material is pulverized by a roll crusher, adjusted for particle size by using an air sifter and a sieve shaker, sintered, and crushed and classified to obtain an irregular shaped ferrite (carrier core material)

The coating resin described above can be coated on the above irregular shaped ferrite (carrier core material) by known methods, for example, brush coating, dry processes, a fluidized bed spray drying, rotary drying and immersion/drying using a universal stirrer. The fluidized bed process is preferable to increase the coating coverage.

For baking the resin after the resin is coated on the carrier core material, either of an externally heating system and an internally heating system can be used, and, for example, a fixed-type or flow-type electric furnace, a rotary electric furnace, a burner furnace, or the microwave can be used. The temperature for baking is different depending on a using resin, and a temperature of not less than the melting point or the glass transition temperature is needed. For a thermosetting resin, a condensation-crosslinkable resin and the like, the temperature needs to be raised to full curing.

<A Developer for Electrophotography According to the Present Invention>

A developer for electrophotography according to the present invention will be explained.

A toner particle constituting a developer of the present invention involves a pulverized toner particle produced by the pulverizing method, and a polymerized toner particle produced by the polymerizing method. In the present invention, the toner particle obtained by either of them can be used.

The pulverized toner particle can be obtained, for example, by fully mixing a binding resin, a charge controlling agent and a colorant by a mixer such as a Henschel mixer, then melting and kneading by a biaxial extruder, etc., cooling, pulverizing, classifying, adding with additives, and thereafter mixing by a mixer, etc.

The binding resin constituting the pulverized toner particle is not especially limited, but includes a polystyrene, chloropolystyrene, styrene-chlorostyrene copolymer, styrene-acrylate copolymer, styrene-methacrylate copolymer, and further, a rosin-modified maleic acid resin, epoxide resin, polyester resin and polyurethane resin. These are used alone or by mixing.

As the charge controlling agent, an optional one can be used. A positively chargeable toner includes, for example, a nigrosin dye and a quaternary ammonium salt, and a negatively chargeable toner includes, for example, a metal-containing monoazo dye.

As the colorant (coloring material), conventionally known dyes and pigments may be used. For example, carbon black, phthalocyanine blue, permanent red, chrome yellow, phthalocyanine green and the like can be used. Otherwise, additives such as a silica powder and titania for improving the fluidity and cohesion resistance of the toner can be added corresponding to the toner particle.

The polymer toner particle is produced by known methods such as suspension polymerization, emulsion polymerization, emulsion coagulation, ester elongation polymerization and phase transition emulsion. Such a toner particle by the polymerization methods is obtained, for example, by mixing and agitating a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while agitating and mixing. Thereafter, the polymerized dispersion is added with a salting-out agent, and the polymerized particle is salted out. The particle obtained by the salting-out is filtrated, washed and dried to obtain the polymerized toner particle. Thereafter, the dried toner particle is optionally added with an additive.

Further, on producing the polymerized toner particle, a fixability improving agent and a charge controlling agent can be blended other than the polymerizable monomer, surfactant, polymerization initiator and colorant, thus allowing to control and improve various properties of the polymerized toner particle obtained using these. Further, a chain-transfer agent can be used to improve the dispersibility of the polymerizable monomers in the aqueous medium, and adjust the molecular weight of the product polymer.

The polymerizable monomer used for the production of the above polymerized toner particle is not especially limited, but includes, for example, styrene and its derivatives, ethylenic unsaturated monoolefins such as ethylene and propylene, halogenated vinyls such as vinyl chloride, vinylesters such as vinyl acetate, and α-methylene aliphatic monocarboxylate such as methyl acrylate, ethyl acrylate, methyl methacrylate, ethyl methacrylate, 2-ethylhexyl methacrylate, acrylic acid dimethylaminoester and methacrylic acid diethylaminoester.

As the colorant (coloring material) used for preparing the above polymerized toner particle, conventionally known dyes and pigments may be used. For example, carbon black, phthalocyanine blue, permanent red, chrome yellow and phthalocyanine green can be used. The surface of colorants may be improved by using a silane coupling agent, a titanium coupling agent and the like.

As the surfactant used for the production of the above polymerized toner particle, an anionic surfactant, a cationic surfactant, an amphoteric surfactant and a nonionic surfactant can be used.

Here, the anionic surfactant includes sodium oleate, a fatty acid salt such as castor oil, an alkylsulfate such as sodium laurylsulfate and ammonium laurylsulfate, an alkylbenzenesulfonate such as sodium dodecylbenzenesulfonate, an alkylnaphthalenesulfonate, an alkylphosphate, a naphthalenesulfonic acid-formalin condensate, a polyoxyethylene alkylsulfate, etc. The nonionic surfactant includes a polyoxyethylene alkyl ether, a polyoxyethylene aliphatic acid ester, a sorbitan aliphatic acid ester, a polyoxyethylene alkylamine, glycerin, an aliphatic acid ester, an oxyethylene-oxypropylene block polymer, etc. Further, the cationic surfactant includes alkylamine salts such as laurylamine acetate, and quaternary ammonium salts such as lauryltrimethylammonium chloride, stearyltrimethylammonium chloride, etc. Then, the amphoteric surfactant includes an aminocarbonate, an alkylamino acid, etc.

Such a surfactant is generally used in an amount within the range of 0.01 to 10 wt. % to a polymerizable monomer. Since the use amount of such a surfactant affects the dispersion stability of the monomer, and affects the environmental dependability of the obtained polymerized toner particle, it is preferably used in the amount within the above range where the dispersion stability of the monomer is secured, and the polymerized toner particle does not excessively affect the environmental dependability.

For the production of the polymerized toner particle, a polymerization initiator is generally used. The polymerization initiators come in a water-soluble polymerization initiator and an oil-soluble polymerization initiator, and both of them can be used in the present invention. The water-soluble polymerization initiator used in the present invention includes, for example, a peroxosulfate salt such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan and tert-dodecylmercaptan, and carbon tetrabromide, etc.

Further, in the case where a polymerized toner particle used in the present invention contains a fixation improving agent, as the fixation improving agent, a natural wax such as a carnauba wax, and an olefinic wax such as a polypropylene and a polyethylene can be used.

In the case where a polymerized toner particle used in the present invention contains a charge controlling agent, the charge controlling agent to be used is not especially limited, and a nigrosine dye, a quaternary ammonium salt, an organic metal complex, a metal-containing monoazo dye and the like can be used.

The additive used for improving the fluidity etc. of a polymerized toner particle includes silica, titanium oxide, barium titanate, fluorine resin microparticles, acrylic resin microparticles, etc., and these can be used alone or in combination thereof.

Further, the salting-out agent used for separating a polymerized particle from an aqueous medium includes metal salts such as magnesium sulfate, aluminum sulfate, barium chloride, magnesium chloride, calcium chloride and sodium chloride.

The average particle size of the toner particles as produced above is in the range of 2 to 15 μm, preferably in the range of 3 to 10 μm. The polymerized toner particle has a higher uniformity of size than the pulverized toner particle. The toner particle of less than 2 μm decreases the electrification capability and is apt to bring about the fogging of image and toner scattering. Toner particles exceeding 15 μm contribute to degradation of image quality.

By mixing the carrier and the toner produced as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fogging of image are apt to occur.

The developer mixed as above can be used in copying machines, printers, FAXs, printing presses and the like, in the digital system, which use the development system in which electrostatic latent images formed on a latent image holder having an organic photoconductor layer are reversal-developed by magnetic brushes of the two-component developer having the toner and the carrier while impressing a bias electric field. It is also applicable to full-color machines and the like which use an alternating electric field, which is a method to superimpose an AC bias on a DC bias, when the developing bias is applied from magnetic brushes to the electrostatic latent image side.

Hereinafter, the present invention will be specifically explained by way of examples.

EXAMPLE 1

Raw materials were weighed such that the composition ratio after sintering became MnO of 20 mol %, and $Fe_2O_3$ of 80 mol %; and the weighed raw materials of 100 parts by weight were added with $TiO_2$ of 0.1 parts by weight and carbon black of 0.2 parts by weight, mixed by a mixer having high-speed stirring blades, granulated by a pressure molding machine, and then held at 950° C. for 1 h for calcination. The calcined material was pulverized by a roll crusher, and then adjusted for particle size by an air sifter and a sieve shaker. The calcined material was held at a temperature of 1,300° C. in an oxygen concentration of 0.1% for 4 h in an electric furnace for sintering. Thereafter, The sintered material was crushed and classified to obtain a carrier core material.

Next, a resin solution was prepared as follows.

Silicone resin (trade name: SR-2411, solid content of 20wt. %, manufactured by Dow Corning Toray Silicone Co., Ltd.): 500 parts by weight γ-Aminopropyltriethoxysilane: 10 parts by weight Toluene: 300 parts by weight The resin solution thus prepared was coated on the above ferrite particle of 1,000 parts by weight by using a fluidized bed coating apparatus, and further baked at 200° C. for 2 h to obtain a ferrite carrier coated with the above resin. The properties of the resin-coated ferrite carrier thus obtained are shown in Table 1. The measured properties were the shape factor (SF-1), its deviation (δ), the ratio of the shape factor (SF-1) of 140 or more, the shape factor (SF-2), the apparent density, the specific surface area, the average particle size, the saturation magnetization and the resistance. The measuring methods were as described above. An electron micrograph (magnification of 100) of the irregular shaped ferrite carrier (rock candy sugar shape) thus obtained is shown in FIG. 1. As evidenced from this electron micrograph, the particles of 80 percent by number or more are found to have the rock candy sugar shape.

A developer was prepared from the obtained resin-coated ferrite carrier according to the process below, and evaluated on an actual machine.

As a toner used with this carrier, a toner for FANTASIA200, manufactured by Toshiba Tec Corp. was used, and a developer was adjusted such that the toner concentration was 5%. The developer was evaluated for the continuous printing by using the FANTASIA200, manufactured by Toshiba Tec Corp. The image evaluation (image density, image density after the continuous printing of 30,000 sheets, carrier adhesion, toner scattering, color stain of color toner) at the printing evaluation was conducted on the following standard. The results are shown in Table 2. In the evaluation in Table 2, "M" and higher ranks denote levels of no problem in the practical use.

EXAMPLE 2

An irregular shaped ferrite carrier coated with the resin was obtained as in Example 1, but by changing the pulverizing conditions through the gap between rolls of the roll crusher. The properties of the obtained resin-coated ferrite carrier were evaluated according to Example 1. The results are shown in Table 1. An electron micrograph (magnification of 100) of the irregular shaped ferrite carrier (oyster shell shape) thus obtained is shown in FIG. 2. As evidenced from this electron micrograph, the particles of 80 percent by number or more are found to have the oyster shell shape. As in Example 1 by using the resin-coated ferrite carrier thus obtained, a developer was prepared, and evaluated on an actual machine. The results are shown in Table 2.

EXAMPLE 3

Raw materials were weighed as in Example 1, then added with water of 15 wt. %, mixed and granulated by a Henschel mixer. An irregular shaped ferrite carrier coated with the resin was obtained as in Example 1 after the calcination. Observation of the irregular shaped ferrite carrier on electron micrography showed that the particles of 80 percent by number or more had the oyster shell shape. The properties of the obtained resin-coated ferrite carrier were evaluated according to Example 1. The results are shown in Table 1. As in Example 1 by using the resin-coated ferrite carrier thus obtained, a developer was prepared, and evaluated on an actual machine. The results are shown in Table 2.

EXAMPLE 4

An irregular shaped ferrite carrier coated with the resin was obtained as in Example 1, but by setting the calcination temperature to be 850° C. and by changing the pulverizing conditions through the gap between rolls of the roll crusher. Observation of the irregular shaped ferrite carrier on electron micrography showed that the particles of 60 percent by number or more had the oyster shell shape. The properties of the obtained resin-coated ferrite carrier were evaluated according to Example 1. The results are shown in Table 1. As in Example 1 by using the resin-coated ferrite carrier thus obtained, a developer was prepared, and evaluated on an actual machine. The results are shown in Table 2.

Comparative Example 1

Raw materials were weighed such that the composition ratio after sintering became MnO of 20 mol %, and $Fe_2O_3$ of 80 mol %; and the weighed raw materials were added with water, pulverized and mixed in a wet ball mill for 5 h, dried, and thereafter held and calcined at 950° C. for 1 h. The calcined powder was added with water, and pulverized in a wet ball mill for 7 h to obtain a slurry, which was added with a dispersant and a binder in appropriate amounts, and then granulated and dried by a spray drier to obtain a granulated material. The obtained granulated material was held and sintered at a temperature of 1,300° C. in an oxygen concentration of 0.1% for 4 h. Thereafter, the sintered material was crushed and classified to obtain a carrier core material. By coating the carrier core material with the resin as in Example 1, a ferrite carrier coated with the resin was obtained. Observation of the ferrite carrier material on electron micrography showed that almost all particles had the complete spherical shape. The properties of the obtained resin-coated ferrite carrier were evaluated according to Example 1. The results are shown in Table 1. As in Example 1 by using the resin-coated ferrite carrier thus obtained, a developer was prepared, and evaluated on an actual machine. The results are shown in Table 2.

Comparative Example 2

A spherical iron powder (ASRV-100), manufactured by Powdertech Co., Ltd. was used as the core material. The core material of the iron powder particle was coated with the resin as in Example 1 to obtain an iron powder carrier coated with the resin. Observation of the iron powder carrier on electron micrography showed that almost all particles had the complete spherical shape. The properties of the obtained resin-coated iron powder carrier were evaluated according to Example 1. The results are shown in Table 1. As in Example 1 by using the resin-coated iron powder carrier thus obtained, a developer was prepared, and evaluated on an actual machine. The results are shown in Table 2.

Comparative Example 3

Raw materials were weighed such that the composition ratio after sintering became CuO of 20 mol %, ZnO of 25 mol % and $Fe_2O_3$ of 55mol %; and the weighed raw materials were added with water, pulverized and mixed in a wet ball mill for 5 h, dried, and thereafter held and calcined at 950° C. for 1 h. The calcined powder was added with water, and pulverized in a wet ball mill for 7 h to obtain a slurry, which was added with a dispersant and a binder in appropriate amounts, and then granulated and dried by a spray drier to obtain a granulated material. The obtained granulated material was held and sintered at a temperature of 1,200° C. for 4 h in a burner furnace. Thereafter, The sintered material was crushed and classified to obtain a carrier core material.

Then, a resin solution was prepared as follows.

Silicone resin (trade name: SR-2411, solid content of 20 wt. %, manufactured by Dow Corning Toray Silicone Co., Ltd.): 500 parts by weight γ-Aminopropyltriethoxysilane: 10 parts by weight Ketjen Black EC (manufactured by Ketjen Black International Co.): 30 parts by weight Toluene: 300 parts by weight The resin solution thus prepared was coated on the above ferrite particle of 1,000 parts by weight by using a fluidized bed coating apparatus, and further baked at 200° C. for 2 h to obtain a ferrite carrier coated with the above resin. Observation of the ferrite carrier on electron micrography showed that almost all particles had the complete spherical shape. The properties of the obtained resin-coated ferrite carrier were evaluated according to Example 1. The results are shown in Table 1. As in Example 1 by using the resin-coated ferrite carrier thus obtained, a developer was prepared, and evaluated on an actual machine. The results are shown in Table 2.

Comparative Example 4

"EFY-50BW" (manufactured by Powdertech Co., Ltd.) used in production of the carrier A in Japanese Patent Laid-Open No. 2002-116582 was used as the irregular shaped carrier core material.

Next, a resin solution was prepared as follows.

Silicone resin (trade name: SR-2411, solid content of 20 wt. %, manufactured by Dow Corning Toray Silicone Co., Ltd.): 500 parts by weight γ-Aminopropyltriethoxysilane: 10 parts by weight Ketjen Black EC (manufactured by Ketjen Black International Co.): 60 parts by weight Toluene: 600 parts by weight The resin solution thus prepared was coated on the above ferrite particle of 1,000 parts by weight by using a fluidized bed coating apparatus, and further baked at 200° C. for 2 h to obtain a ferrite carrier coated with the above resin. The content of the conductive microparticle in the coated resin layer was 60 wt. %, and about 30 vol. % in terms of volume. Observation of the irregular shaped ferrite carrier on electron micrography showed that the particles of about 70% had the rock candy sugar shape. The properties of the obtained resin-coated ferrite carrier were evaluated according to Example 1. The results are shown in Table 1. As in Example 1 by using the resin-coated ferrite carrier thus obtained, a developer was prepared, and evaluated on an actual machine. The results are shown in Table 2.

TABLE 1

| | Shape | Shape factor (SF-1) | Percentage of SF-1 of 140 or more (%) | Distribution of shape factor (σ) | Shape factor (SF-2) | Apparent density (g/cm$^3$) | Specific surface area (cm$^2$/g) | Average particle size (μm) | Saturation magnetization (A · m$^2$/kg) | Resistance (Ω) |
|---|---|---|---|---|---|---|---|---|---|---|
| Ex. 1 | Rock candy sugar shape | 142 | 49 | 58 | 123 | 2.32 | 199 | 100.6 | 94 | $8.3 \times 10^9$ |
| Ex. 2 | Oyster shell shape | 155 | 79 | 45 | 138 | 2.07 | 289 | 80.7 | 93 | $7.7 \times 10^7$ |
| Ex. 3 | Oyster shell shape | 160 | 58 | 52 | 125 | 1.95 | 224 | 79.7 | 94 | $4.3 \times 10^8$ |
| Ex. 4 | Oyster shell shape | 228 | 66 | 57 | 211 | 2.24 | 205 | 111.4 | 94 | $6.4 \times 10^8$ |
| Com. Ex. 1 | Complete spherical shape | 115 | 2 | 38 | 112 | 2.66 | 146 | 81.6 | 91 | $1.8 \times 11^{10}$ |
| Com. Ex. 2 | Complete spherical shape | 108 | 1 | 32 | 108 | 2.86 | 120 | 113.4 | 175 | $3.5 \times 11^{10}$ |
| Com. Ex. 3 | Complete spherical shape | 109 | 2 | 46 | 115 | 2.77 | 106 | 120.5 | 65 | $3.3 \times 10^7$ |
| Com. Ex. 4 | Rock candy sugar shape | 182 | 79 | 67 | 132 | 1.78 | 415 | 51.8 | 72 | $2.8 \times 11^5$ |

(Image Density)

The developments were conducted under an optimum exposure condition. The image densities of the solid parts were measured by an X-Rite (manufactured by X-Rite Inc.), and ranked.

E: not less than 1.6

G: not less than 1.4 and less than 1.6

M: not less than 1.2 and less than 1.4

P: not less than 1.0 and less than 1.2

B: less than 1.0

(Image Density after 30,000-sheet Continuous Printing)

The 30,000-sheet continuous printing was conducted under an optimum exposure condition. The image densities of the solid parts were measured by an X-Rite (manufactured by X-Rite Inc.), and ranked as above (Image Density).

(Carrier Adhesion)

The developments were conducted under an optimum exposure condition, and the levels of white spots due to carrier adhesion on images were visually judged, and ranked.

E: No white spot in 10 sheets of A3 paper

G: 1 to 5 white spots in 10 sheets of A3 paper

M: 6 to 10 white spots in 10 sheets of A3 paper

P: 11 to 20 white spots in 10 sheets of A3 paper

B: 21 or more white spots in 10 sheets of A3 paper (Toner Scattering)

The interior of the machine after 30,000-sheet continuous printing was observed, and visually judged and ranked.

E: No contamination in the machine interior was found, and a clean state was maintained.

G: A little contamination in the machine interior was found, but a clean state was found.

M: Contamination in the machine interior was found, but was on a level of no problem.

P: A heavy contamination in the machine interior was found, and problems arise even on papers.

B: Can never be used.

(Color Stain of Color Toner)

The developments were conducted under an optimum exposure condition, and visually judged and ranked.

E: No color stain was found, and images were clear.

G: A little color stain was found, but images were clear.

M: Color stain was found, but was on a practical level.

P: Heavy color stain was found, and was below a practical level.

B: Can never be used.

(Comprehensive Judgment)

E: Excellent in all points

G: Good

M: On a practical level but with a few of drawbacks

P: Below a practical level

B: Can never be used

TABLE 2

| | Image density | Image density after 30K continuous printing | Carrier adhesion | Toner scattering | Color stain of color toner | Comprehensive judgment |
|---|---|---|---|---|---|---|
| Ex. 1 | M | M | G | M | E | M |
| Ex. 2 | E | E | E | E | E | E |
| Ex. 3 | G | E | G | G | E | G |
| Ex. 4 | E | G | M | M | E | M |
| Com. Ex. 1 | B | B | E | B | E | P |
| Com. Ex. 2 | P | B | G | B | E | B |
| Com. Ex. 3 | P | B | P | B | B | B |
| Com. Ex. 4 | G | B | B | B | B | B |

As clarified from the results in Table 2, Examples 1 to 4 are in practically practical levels in any of the image density, the image density after 30,000-sheet continuous printing, the carrier adhesion, the toner scattering, and the color stain of color toner. Especially Example 2 is superior in any items. By contrast, Comparative Examples 1 to 4 are inferior in the image density after 30,000-sheet continuous printing, the toner scattering, etc.

The irregular shaped ferrite carrier according to the present invention is composed mainly of particles which have a rock candy sugar shape or an oyster shell shape, and have a shape factor (SF-1) in a specified range and a distribution width (δ) of a certain value or less, and thereby has a low resistance, a high specific surface area, and a low specific gravity, leading to a longer operating life. Accordingly, the electrophotographic developer using the irregular shaped ferrite carrier according to the present invention prevents the toner scattering, provides a high image density, and can fully respond to the high-speed and full-color imaging of developing machines.

What is claimed is:

1. An irregular shaped ferrite carrier, comprising carrier particles which are irregular shaped and said carrier has a shape factor (SF-1), represented by the below expression, from 140 to 250 and a distribution width (δ) of 45 to 60, and wherein 49 to 79 percent of the carrier particles have a shape factor (SF-1) of greater than 140, $$SF\text{-}1=R^2/S\times\pi/4\times100$$

wherein R is a maximum length and S is a projected area.

2. The irregular shaped ferrite carrier according to claim 1, wherein the shape factor (SF-1) is 145 to 200.

3. The irregular shaped ferrite carrier according to claim 1, wherein the particles have a distribution width (δ) of the shape factor (SF-1) of 45 to 55.

4. The irregular shaped ferrite carrier according to claim 1, wherein the carrier has a ferrite composition shown by the below formula.

$$(MO)_x(Fe_2O_3)_y$$

wherein M is at least one selected from Mn, Mg, Sr and Ca; and x+y=100, and y is 40 to 95 mol %.

5. The irregular shaped ferrite carrier according to claim 4, wherein said M is Mn and/or Mg.

6. The irregular shaped ferrite carrier according to claim 4, wherein the ferrite composition contains a titanium compound.

7. The irregular shaped ferrite carrier according to claim 6, wherein the ferrite composition contains 0.01 to 5 parts by weight of the titanium compound in terms of titanium based on 100 parts by weight of the ferrite component.

8. The irregular shaped ferrite carrier according to claim 1, wherein the carrier is coated with a resin.

9. The irregular shaped ferrite carrier according to claim 1, wherein the apparent density thereof is 1.50 to 2.40 g/cm$^3$.

10. The irregular shaped ferrite carrier according to claim 1, wherein the specific surface area thereof is 150 to 600 cm$^2$/g.

11. The irregular shaped ferrite carrier according to claim 1, wherein the average particle size thereof is 30 to 120 μm.

12. The irregular shaped ferrite carrier according to claim 1, wherein the saturation magnetization thereof is 75 to 97 emu/g (A·m$^2$/kg).

13. The irregular shaped ferrite carrier according to claim 1, wherein the resistance thereof is $10^2$ to $10^{10}\Omega$.

14. The irregular shaped ferrite carrier according to claim 1, wherein the carrier is used for a color toner.

15. An electrophotographic developer consisting essentially of the irregular shaped ferrite carrier of claim 1 and a toner, wherein the toner concentration is between 3 to 15%.

16. The electrophotographic developer according to claim 15, wherein the toner is a color toner.

* * * * *